US005644984A

United States Patent [19]

Puschnerat et al.

[11] Patent Number: 5,644,984

[45] Date of Patent: Jul. 8, 1997

[54] CYLINDER WITH PLATE CLAMPING DEVICE

[75] Inventors: Helmut Puschnerat, Wachenheim; Wolfgang Günter Ruckmann, Würzburg; Peter Schröder, Hessheim, all of Germany

[73] Assignee: Koenig & Bauer-Albert Aktiengesellschaft, Wurzburg, Germany

[21] Appl. No.: 616,578

[22] Filed: Mar. 15, 1996

[30] Foreign Application Priority Data

Mar. 16, 1995 [DE] Germany ..... 195 09 563.4

[51] Int. Cl.[6] ..... B41F 1/28; B41F 1/30

[52] U.S. Cl. ..... 101/409; 101/415.1

[58] Field of Search ..... 101/409, 415.1

[56] References Cited

U.S. PATENT DOCUMENTS

| | | | |
|---|---|---|---|
| 2,109,152 | 2/1938 | Meisel | 101/415.1 |
| 3,626,848 | 12/1971 | Tafel et al. | 101/415.1 |
| 3,727,551 | 4/1973 | Kostas et al. | 101/415.1 |
| 3,913,480 | 10/1975 | Dauner et al. | 101/415.1 |

FOREIGN PATENT DOCUMENTS

| | | | |
|---|---|---|---|
| 639454 | 2/1995 | European Pat. Off. | 101/415.1 |
| 2 126 941 | 11/1972 | Germany . | |
| 42 38 343 | 5/1994 | Germany . | |

OTHER PUBLICATIONS

Patent Abstracts Of Japan; No. JP–A–02 103148; vol. 14, #311; Jul. 4, 1990.

*Primary Examiner*—Edgar S. Burr
*Assistant Examiner*—Leslie Grohusky
*Attorney, Agent, or Firm*—Jones, Tullar & Cooper, P.C.

[57] ABSTRACT

A plate clamping device which is usable to secure at least one end of a flexible plate to a cylinder utilizes a group of spring fingers that are shiftable radially in an axially extending slit in the cylinder to engage apertures in the end of the plate. The spring fingers have barbs that are receivable in these plate end apertures. The spring fingers are shiftable radially in the cylinder slit by rotation of a spindle situated in the cylinder.

12 Claims, 3 Drawing Sheets

CYLINDER WITH PLATE CLAMPING DEVICE

FIELD OF THE INVENTION

The present invention is directed generally to a cylinder with a plate clamping device. More particularly, the present invention is directed to a cylinder with a device for clamping plates having beveled or angled ends. Most specifically, the present invention is directed to a device for clamping plates having beveled or angled ends onto a cylinder of a rotary printing press. The cylinder has a generally axially extending, generally radially directed slit, together with a rotatable spindle which is positioned so that an inner end of the slit is tangent to the surface of the spindle. A plurality of spring fingers or tongues are attached, at their inner ends, to the spindle and extend out in the slit. These spring fingers or tongues have barbed outer ends which are engageable with cut-outs in the plate end.

DESCRIPTION OF THE PRIOR ART

In the field of rotary printing, it is generally conventional to secure flexible plates or blankets to the surfaces of various cylinders. In typical applications, a flexible printing plate or a flexible resilient blanket will be secured to the surface of a plate cylinder or a blanket cylinder by having the ends of the plate or blanket engaged by appropriate clamping devices. These prior plate or blanket end clamping devices are often quite complex and require a substantial area of the cylinder's periphery. This reduces the available printing space and tends to make the cylinder run in a non-smooth fashion.

One clamping and tensioning device on a printing cylinder, which is usable to secure a printing plate, that is in the form of a thin plate or foil, to the surface of the cylinder is shown in German Patent Publication DE 42 38 343 A1. In this prior device, both ends of the printing plate or foil are inserted into a narrow, axially extending slit in the printing cylinder. The plate or foil ends are held and tensioned by a clamping and tensioning device that is situated in the interior of the cylinder. In this device, the clamping and tensioning device consists of an actuating spindle on which a plurality of tensioning rollers have been threaded. Rotation of these tensioning rollers on the spindle can be accomplished only after a friction clutch between the fastening spindle and the tensioning rollers has been overcome. The fastening spindle is resiliently supported at both ends. This allows the various rollers to be pressed against the ends of the printing plate or foil that are inserted into the slit. The rollers follow the rotation of the actuating or fastening spindle and pull the ends of the printing plate or foil into the cylinder slit when the plate is being mounted on the surface of the cylinder and its ends are being pushed into the slit.

In the German Published, Non-Examined Patent Application DE-OS 21 26 941, there is disclosed a plate cylinder with a device for clamping a printing plate. In this prior art device, the plate cylinder is provided with a rotatable spindle that is located in a trough in the cylinder. A pulling plate than is provided with a strip is fastened on this cylinder. One end of the printing plate is provided with a tool that is engageable with the strip on the spindle.

These prior art printing plate end clamping devices are somewhat complex structures that require significant manipulation of the ends of the plate and that also reduce the usable circumferential areas of the cylinders on which they are provided. It will thus be seen that a need exists for a plate clamping device which overcomes the limitations of the prior art. The cylinder with a plate clamping device in accordance with the present invention provides such a device and is a significant improvement over the prior art.

SUMMARY OF THE INVENTION

It is an object of the present invention to provide a cylinder with a plate clamping device.

Another object of the present invention is to provide a cylinder with a device for clamping plates having beveled or angled ends.

A further object of the present invention is to provide a device for clamping plates with beveled ends on a cylinder of a rotary printing press.

Still another object of the present invention is to provide a plate clamping device which will pull a beveled end of a plate into a narrow slit cut in the surface area of the cylinder.

Yet a further object of the present invention is to provide a plate beveled or angled end clamping device that will securely hold the plate end.

Even still another object of the present invention is to provide a plate end clamping device that is uncomplicated and which requires little cylinder surface space.

As will be discussed in detail in the description of the preferred embodiment which is presented subsequently, the plate clamping device in accordance with the present invention is usable to clamp or secure a plate or foil that has beveled or angled ends to the surface of a cylinder of a rotary printing press. The cylinder is provided with an axially extending, generally radially directed thin slit that extends into the body of the cylinder from its periphery. A rotatable spindle is positioned within the cylinder and an inner end of the narrow slit is generally tangent to the rotatable spindle. A plurality of spring tongues or fingers are secured at their inner ends, to the rotatable spindle so that they are extendable and retractable in this slit. A free, outer end of each spring finger has a barb which is shaped to engage a cooperatively shaped cut-out in the beveled or angled end of the flexible plate. Once the barbs have been received in the cut-outs, the rotatable spindle can be turned to pull the beveled end of the plate radially inwardly into the slit to firmly secure the plate to the cylinder.

One particular advantage of the present invention is that the slit formed in the surface of the plate or blanket receiving cylinder is quite thin. The width of this slit is only slightly greater than twice the thickness of the beveled ends of the plate or blanket being secured to the cylinder. It is not necessary to change the thickness of the beveled ends of a plane in order to allow the plate ends to be grasped by the present invention. The slit has several partially widened segments which allow the free ends of the resilient tongue or fingers to flex during plate securement ahd removal. Since the slit is quite narrow, the cylinder which is provided with this slit will roll in engagement with a cooperating cylinder in a smooth manner. There will be no channel knocking or cylinder dropping, as is frequently the case when one of the cooperating cylinders is provided with a relatively wide channel. The elimination of this channel knocking or cylinder drop eliminates oscillations in the cylinder which otherwise would occur.

In the plate clamping device in accordance with the present invention, there is no threading of the plate end onto a spindle that is located within a trough. This makes manipulation of the plate or other foil or blanket secured to the cylinder much easier. The operational dependability of the cylinder and of the printing press generally is thus greatly improved.

The cylinder with a plate clamping device in accordance with the present invention overcomes the limitations of the prior art device. It is a substantial advance in the art.

BRIEF DESCRIPTION OF THE DRAWINGS

While the novel features of the cylinder with a plate clamping device in accordance with the present invention are set forth with particulariny in the appended claims, a full and complete understanding of the invention may be had by referring to the detailed description of the preferred embodiment, which is set forth subsequently, and as illustrated in the accompanying drawings, in which:

DETAILED DESCRIPTION OF THE PREFERRED EMBODIMENT

Figure 1:
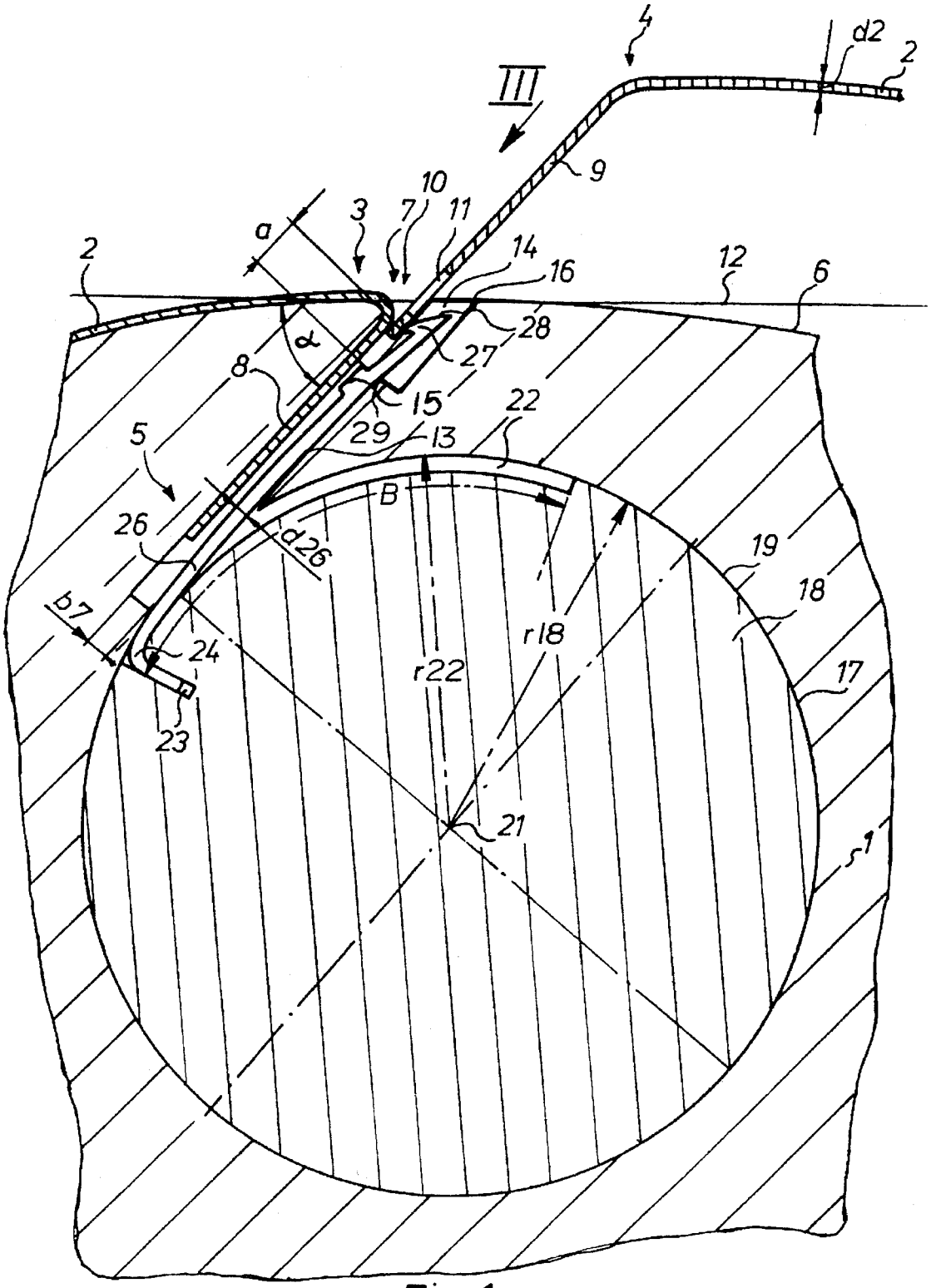
FIG. 1 is a schematic cross-sectional view through a portion of a cylinder and showing the plate clamping device in accordance with the present invention in a plane insertion portion.
Figure 2:
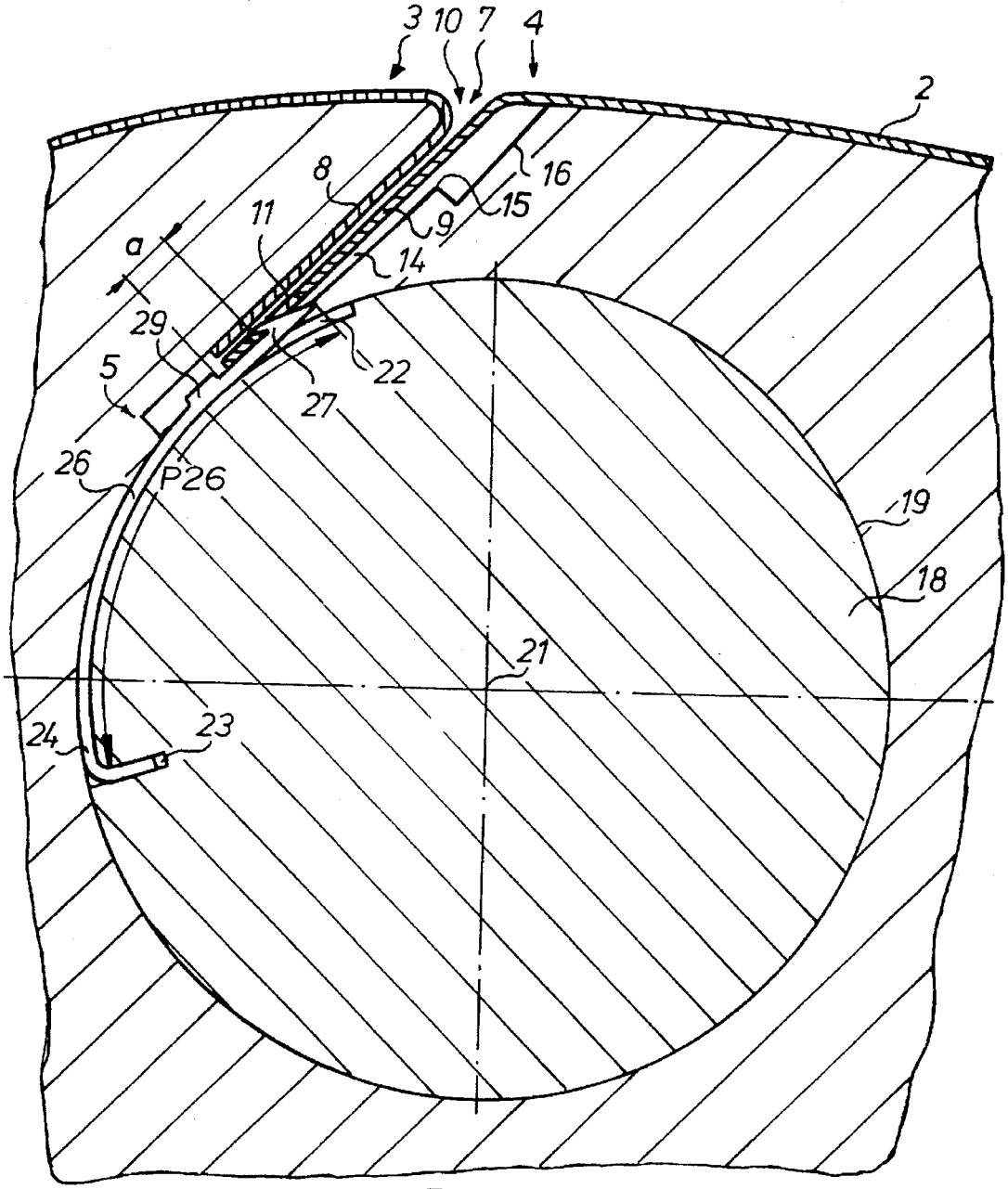
FIG. 2 is a view generally similar to FIG. 1 and showing the plate clamping device in the clamping position.

Referring initially to FIGS. 1 and 2, there may be seen at 1 a portion of a cylinder. It will be understood that cylinder 1 is a portion of a rotary printing press and could be a printing plate receiving cylinder, a resilient blanket receiving cylinder, or another type of cylinder. For the purpose of this description, cylinder 1 will be described as a plate cylinder. However, it will be understood that this description is for convenience and is not to be construed as a limitation on the type of cylinder with which the plate clamping device of the present invention can be used. It will also be understood that cylinder 1 generally, and the rotary printing press of which it is a part, form no part of the subject invention and thus are not discussed or described in detail.

Figure 3:
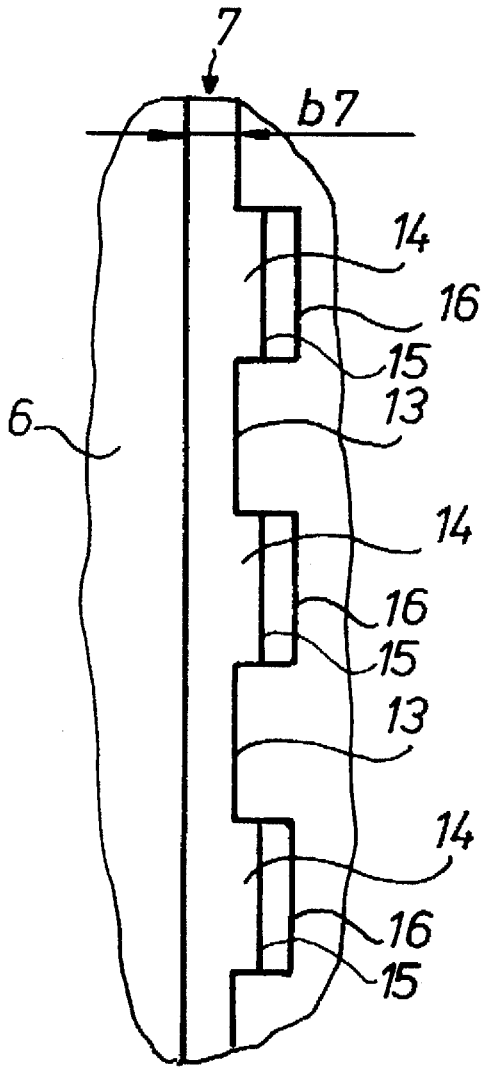
FIG. 3 is a schematic top view of a portion of the cylinder and showing the slit in the surface area of the cylinder.

As is shown in FIGS. 1 and 2, as well as FIG. 3, cylinder 1 is provided with an axially extending, generally radially directed thin or narrow slit 7 which extends across cylinder 1 generally parallel with an axis of rotation of the cylinder. The slit 7 extends generally radially inwardly into the interior 5 of cylinder 1 from an outer slit end 10 which is coincident with a surface area 6 of the cylinder. The slit 7 is intended to receive the beveled or angled ends 3 and 4 of a flexible plate 2 which may be a flexible printing plate. The plate 2 has a thickness d2 which may be, for example, d2=0.3 mm and while preferably being a printing plate, can also be a support plate with a rubber blanket or the like fastened to it. Plate end legs 8 and 9 are situated on the beveled ends 3 and 4, respectively, of plate 2. As may be seen in FIGS. 1 and 2, the end leg 9 of the trailing end 4 of the plate 2 has a plurality of axially spaced, generally rectangular cut-outs 11 disposed next to each other.

Again referring to FIGS. 1 and 2, the thin slit 7 is generally rectangular in cross-section and has a width b7. The width b7 of the slit 7 at its radial outer end 10 is slightly more than twice the thickness d2 of the plate 2. Thus the width b7 may equal approximately 1.0 mm. The slit 7 is inclined at an angle of inclination $\alpha$ which may, for example, be 45° with respect to a longitudinal line 12 that contacts the surface 6 of the cylinder 1 in the area of the radial outer end 10 of the slit 7.

As may be seen in FIGS. 1 and 2, and also in FIG. 3, a first lateral face 13 of the thin slit 7, which is engaged by the leg 9 of the trailing end 4 of the plate 2, is provided with a plurality of axially spaced, generally U-shaped recesses 14 which extend into the slit 7 from the surface 6 of the cylinder 1. The long axis of each U-shaped recess 14 is generally parallel with this lateral face 13. Each of these recesses 14 includes a spring-back or recoil chamber 16 which is facing radially outwardly in the direction of the surface 6 of the cylinder 1. Each recess 14 thus opens generally in the direction of the circumference of the cylinder 1. Each recess 14 also has a bending edge 15 at its radially inner transition.

Referring again to FIGS. 1 and 2, the cylinder 1 is provided with an axially extending bore 17 which extends generally parallel with the thin slit 7. The inner portion of the slit 7 is generally tangent to the bore 17 so that the bore 17 is connected to the slit 7. A pivot lever or spindle 18 is rotatably supported in the cylinder bore 17. In the preferred embodiment, the pivot lever or spindle 18 has a radius r18 of, for example, 15 mm, and is seated for rotation in the bore 17 and is centered in bore 17. A surface portion 19 of the spindle 18 has a plurality of generally U-shaped grooves 22. Each of these grooves 22 has a reduced radius r22 of, for example 14.5 mm. These grooves 22 extend about the circumference 19 of the spindle 18 over a circumferential arcuate distance B of, for example, 80° with respect to a longitudinal axis 21 of the spindle 18.

When viewed in an axial direction of the cylinder 1, the grooves 22 of the spindle 18 and the recesses 14 of the slit 7 are aligned with each other. An axially extending slot or channel 23, which extends radially inwardly from the surface 19 of the spindle 18 towards its center of rotation, has been formed at a first end of these generally U-shaped spindle grooves 22. First, inner ends of flexibly elastic, but pressure and tension-resistant tongues or spring fingers 26 are inserted into this spindle channel 23. These tongues or spring fingers 26 are, in the preferred embodiment embodied as leaf springs which are made of spring steel, for example. These tongues or spring fingers 26 rest in the generally U-shaped grooves 22 of the rotatable spindle 18 and in their installed configuration conform generally to the curvature of the spindle 18. A second, free end of each tongue or spring finger 26 is not connected to the spindle 18 but instead, as may be seen in FIGS. 1 and 2, is situated extending generally radially outwardly in the thin slit 7 toward the surface 6 of the cylinder 1. Each spring finger free end is generally barb-shaped, as depicted at 27, and is provided with a chamfered or generally wedge shaped outer free end 28. The barb 27 faces or points generally in the direction of the leading end 3 of the plate 1 and acts in the direction of the spindle 18. The chamfered barb end 28 extends or faces in the direction of the leading end 3 of the plate 2; i.e. in a direction facing away from the spring back chamber 16. A cam surface 29, which also faces in the direction of the leading end 3 of the plate 2, is spaced radially inwardly on the spring finger or tongue 26 from the chamfered outer end 28. Thus cam surface 29 and the chamfered outer end 28 of the barb 27 are disposed apart from each other by a spacing distance "a", as may be seen in FIGS. 1 and 2. Each tongue has a tongue length, 126 of generally 25 mm and a thickness d26 of, for example, 0.5 mm. The axial positions of the recesses 14 in the slit 7, the grooves 22 in the spindle 18, and the tongues 26 are all coordinated with each other so that the spring fingers 26 will be receivable in the grooves 22 on the spindle and so that the barbs 27 will be positionable in the recesses 14, all as may be seen in FIGS. 1 and 2.

The operation of the plate clamping device in accordance with the present invention will now be discussed in detail. Referring initially to FIG. 1, the plate clamping device is depicted in a plate end insertion position. The leading end B of a flexible plate 2 has been engaged by the leading end engaging edge of the slit 7 and the plate 2 has been wrapped about the surface 6 of the cylinder 1. The barb 27 of each tongue or spring finger 26 is located in the area of the spring back chamber 16 of each recess 14 and is slightly radially interior of the surface 6 of the cylinder 1. The spring fingers 26 have been brought into that position by an appropriate rotation of the spindle 18. With the spring fingers 26 in this insertion position, the beveled or angled trailing end leg 9 of the plate 2 is inserted into the slit 7. This insertion brings the leg 9 initially into contact with the chamfered ends 28 of the barbs 27 and pushes each barb 27 back about its bending edge 15 and into its associated spring back chamber 16 of the recess 14 of the slit 7. This allows the plate end leg 9 to move radially inwardly into the slit 7 until the cutouts 11 of the plate end leg 9 engage the barbs 27 and the tongues 26 spring out of the spring-back chambers 16 of the slit 7. This action securely positions the barb 27 of each tongue or spring finger 26 in its associated cutout 11 in the plate end leg 9 of the plane 2.

Once the barbs 27 are seated in the cutouts 11, the spindle 18 will be rotated in a counterclockwise direction, as is shown in FIG. 2. This rotation will cause the tongues 26 to retract into the thin slit 7 away from the slit outer end 10 and will thus pull the trailing end leg 9 of the plate 2 into the slit 7. In this process, the barbs 27 remain engaged in the plate end cutouts 11 and the plate end leg 9 is retained in the slit 7. Once the plate trailing end leg 9 has been fully drawn into the thin slit 7 by the rotation of the spindle 18, the plate 2 will be effectively clamped on the surface 6 of the cylinder 1. The spindle 18 can then be stopped and prevented from rotating either by a positive locking device or by a resilient assembly.

When it is desired to loosen or unclamp the plate 2 from the surface 6 of the cylinder 1, the spindle 18 can be rotated in a clockwise direction. Starting in the clamped position, as seen in FIG. 2, the spring fingers or tongues 26 will now move outwardly in the slit 7 toward the cylinder peripheral surface 6 so that the barbs 27 will move toward the outer end 10 of the slit 7. The cams 29 of the tongues 26 push against the plate end leg 9 of the trailing end 4 of the plane 2. At the same time, these cams 29 ride against the plate end leg 8 of the plate leading end 3. As the spindle continues to be rotated in the clockwise direction, the tongues 26 will spring outwardly into their stretched position so that the tongues 26 extend generally tangentially with respect to the spindle 18, as may be seen in FIG. 1. The barbs 27 of the spring fingers or tongues 26 are now situated in the recesses 14 of the slit 7. The spindle 18 will continue to be rotated until the plate end leg 9 of the trailing end 4 of the plate 2 is completely removed front the slit 7 so that now the cams 29 of the tongues 26 are situated in the area of the surface 6 of the cylinder 1. The trailing end 4 of the plate 2 can now be removed from the tongues 27.

While the plate clamping device in accordance with the present invention has been discussed hereinabove as acting only on the trailing end 4 of a plate 2, it will be understood that both ends 3 and 4 of a plate 2 could be attached to the same device. Alternatively, separate devices could be provided for both the plate leading and trailing ends 3 and 4.

In an alternate configuration, the slit 7 can be widened in such a way that the beveled or angled ends 3 and 4, as well as the spring fingers or tongues 26 can be received in the slit 7 and the spring back chamber 16 can also be formed. For example, the slit 7 can be widened by the depth of the U-shaped recesses 14 so that these recesses 14 will be omitted from the structure. In such a configuration, the lateral face 13 of the slit 7 would be provided with a bead or a hemispherically shaped raised portion which would form the bending edge 15. This bead or hemispherically shaped raised portion would extend axially parallel to the axis of rotation of the spindle 18. A spring-back chamber 16 would also be created between such a raised edge or part and the radial outer end or beginning 10 of the slit 7.

While a preferred embodiment of a cylinder with a plate clamping device in accordance with the present invention has been set forth fully and completely hereinabove, it will be apparent to one of skill in the art that a number of changes in, for example, the overall size of the cylinder, the type of place secured on the cylinder, the type of rotary printing press in which the cylinder is used and the like may be made without departing from the true spirit and scope of the present invention which is accordingly to be limited only by the following claims.

What is claimed is:

1. A cylinder having a plate clamping device usable to clamp a plate with beveled ends on a surface of the cylinder in a rotary printing press comprising:

an axially extending, generally radially inwardly directed slit in said cylinder, said slit being adapted to receive plate beveled ends, said slit having an inner end and an outer end and at least a first lateral face, and with an axially extending bending edge formed in said first lateral face intermediate said slit inner and outer ends;

a rotatable pivot lever positioned in said cylinder and extending generally parallel to said slit;

a plurality of tongues disposed in said slit and having inner ends secured to said pivot lever, said tongues being shiftable in said slit in response to rotation of said pivot lever;

a barb on an outer end of each of said tongues, each said barb being engageable with a cutout in a beveled plate end; and a spring-back chamber formed in said first lateral face of said slit intermediate said bending edge and said outer end of said slit, said barb on said outer end of each of said tongues being deflectable into said spring-back chamber.

2. The plate clamping device of claim 1 further including a cam on each of said tongues, each said cam being spaced inwardly from said barb and being engageable with a plate beveled end inserted in said slit.

3. The plate clamping device of claim 1 wherein each said tongue is a resiliently flexible material.

4. The plate clamping device of claim 3 wherein each said tongue is spring steel.

5. The plate clamping device of claim 1 further including a chamfered outer end on each of said tongues.

6. The plate clamping device of claim 1 wherein said pivot lever is a rotatable spindle.

7. A cylinder having a plate clamping device usable to clamp a plate with beveled ends on a surface of the cylinder in a rotary printing press comprising:

an axially extending, generally radially inwardly directed slit in said cylinder, said slit being adapted to receive plate beveled ends, said slit having an inner end and an outer end and at least a first lateral face, said first lateral face being provided with a plurality of recesses adjacent said slit outer end, said recesses widening in the direction toward said outer end of said slit;

a rotatable pivot lever positioned in said cylinder and extending generally parallel to said slit;

a plurality of tongues disposed in said slit and having inner ends secured to said pivot lever, said tongues each being shiftable in said slit in response to rotation of said pivot lever; and a barb on an outer end of each of said tongues, each said barb being engageable with a cutout in a beveled plate end, said plurality of recesses forming spring-back chambers for said barbs.

8. The plate clamping device of claim 7 further including a cam on each of said tongues, each said cam being spaced inwardly from said barb and being engageable with a plate beveled end inserted in said slit.

9. The plate clamping device of claim 7 wherein each said tongue is a resiliently flexible material.

10. The plate clamping device of claim 9 wherein each said tongue is spring steel.

11. The plate clamping device of claim 7 further including a chamfered outer end on each of said tongues.

12. The plate clamping device of claim 7 wherein said pivot lever is a rotatable spindle.

* * * * *